United States Patent [19]

Hendrich

[11] 3,971,185

[45] July 27, 1976

[54] METHOD OF ERECTING A FOLDABLE BUILDING MODULE

[76] Inventor: John H. Hendrich, 5 W. 10th St., Erie, Pa. 16501

[22] Filed: Aug. 23, 1974

[21] Appl. No.: 500,085

Related U.S. Application Data

[63] Continuation-in-part of Ser. No. 332,677, Feb. 15, 1973, Pat. No. 3,863,419, which is a continuation-in-part of Ser. No. 178,942, Sept. 9, 1971, abandoned.

[52] U.S. Cl. ..... 52/745; 52/71; 52/79; 52/90

[51] Int. Cl.[2] ..... E04B 1/344; E04G 21/14

[58] Field of Search ..... 52/64, 66, 69, 90, 71, 52/79, 745

[56] References Cited

UNITED STATES PATENTS

| | | | |
|---|---|---|---|
| 420,223 | 1/1890 | Brook | 52/69 |
| 551,977 | 12/1895 | Long | 135/4 R |
| 970,549 | 9/1910 | Price | 135/4 R |
| 2,114,215 | 4/1938 | Dietle | 52/117 |
| 2,503,604 | 4/1950 | Woodslayer et al. | 52/116 |
| 2,592,610 | 4/1952 | Shumaker | 52/69 |
| 3,193,973 | 7/1965 | Lee et al. | 52/90 |
| 3,378,966 | 4/1968 | Lindal | 52/90 |
| 3,714,746 | 2/1973 | Barlow | 52/69 |
| 3,849,953 | 11/1974 | Cohen | 52/71 X |

FOREIGN PATENTS OR APPLICATIONS

| | | | |
|---|---|---|---|
| 530,268 | 9/1956 | Canada | 52/117 |
| 1,268,505 | 6/1961 | France | 52/66 |
| 1,453,984 | 8/1966 | France | 52/90 |
| 1,086,986 | 2/1968 | France | 52/69 |
| 1,491,542 | 7/1967 | France | 52/66 |
| 2,064,201 | 9/1971 | Germany | 52/71 |
| 2,048,512 | 4/1971 | Germany | 52/69 |
| 889,515 | 9/1953 | Germany | 52/90 |
| 884,378 | 12/1961 | United Kingdom | 135/4 R |
| 8,522 | 7/1890 | United Kingdom | 135/4 R |

*Primary Examiner*—Ernest R. Purser
*Assistant Examiner*—Leslie A. Braun
*Attorney, Agent, or Firm*—Fay & Sharpe

[57] ABSTRACT

The specification and drawings disclose several collapsible building modules and methods of erecting them. The primary feature of the application concerns the use of modules which can be folded to a generally flat configuration for shipping and storage. An A-frame type module structure and method of erecting the same is disclosed. The method of erecting the A-frame type structure comprises providing first and second spaced apart bases and providing a module which includes first and second wall-defining members each having first and second end portions with the first end portion of the first wall member pivotally connected to the first end portion of the second wall member to permit the wall members to be folded or pivoted about a first axis to lie in side-by-side, generally parallel relationship. The module is positioned in its folded condition to lie generally horizontal with the second wall member subjacent the first wall member. The second end portion of the second wall member is then connected to the first base for pivotal movement about a second axis parallel to the first axis with the second end portion of the first wall member extending generally toward the second base. Thereafter, the first wall member is lifted to pivot it about the first axis and move the second end portions of the wall members a distance apart substantially equal to the distance between the base members. With the second wall member in the lifted position, a floor member is interconnected between the first and second wall members. Thereafter, the module is lifted to rotate it about the second axis to bring the second end of the first wall member into engagement with the second base.

7 Claims, 27 Drawing Figures

FIG. 2
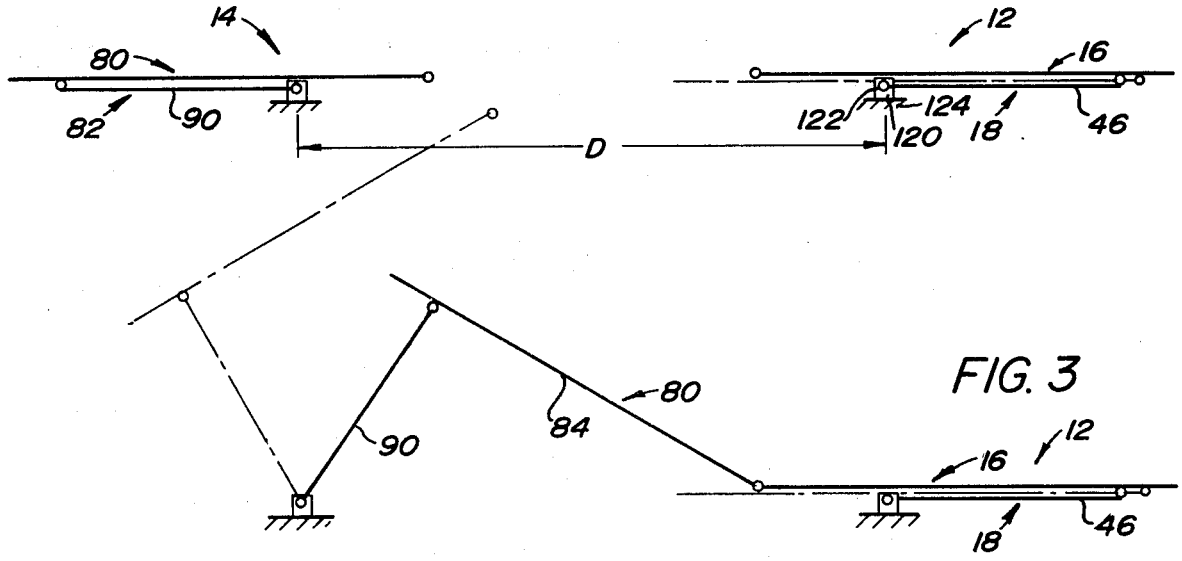
FIG. 3
FIG. 4
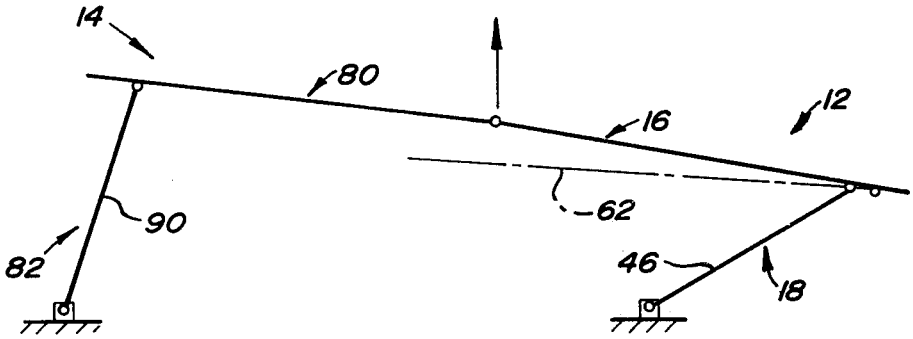
FIG. 5
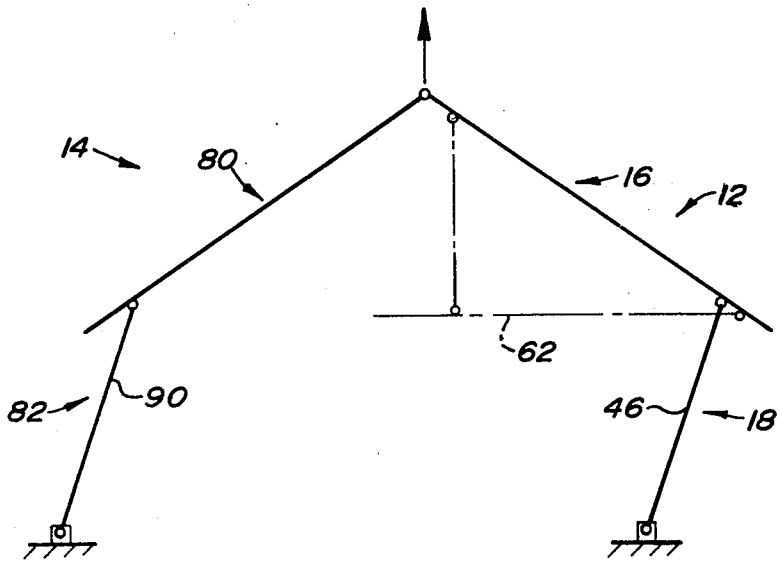

METHOD OF ERECTING A FOLDABLE BUILDING MODULE

This application is a continuation-in-part application of U.S. application Ser. No. 332,677, filed Feb. 15, 1973 and now issued as U.S. Pat. No. 3,863,419 which itself was a continuation-in-part application of application Ser. No. 178,942, filed Sept. 9, 1971 and now abandoned.

BACKGROUND OF THE INVENTION

The subject application is directed toward the art of building structures and, more particularly, to an improved collapsible building module and method of erecting the same.

The invention is particularly suited for use in constructing residential type single or multifamily dwellings and will be described with particular reference thereto; however, as will become apparent, the invention should not be considered as limited in this regard and could obviously be used for constructing many types and sizes of buildings for a variety of uses.

There is currently much interest in the general concept of constructing buildings, particularly residential buildings, from factory-assembled modules. The savings, both in time and money by factory as opposed to on-site construction, can be substantial. However, factory construction has had certain distinct problems.

As can be appreciated, the size and weight of factory-assembled building modules is limited by shipping requirements. For example, the upper acceptable size limitation is somewhere in the neighborhood of 12 feet in width, 40 feet in length, and 10 feet in height. This has tended to limit the types and sizes of buildings. Additionally, certain problems have been encountered in handling and aligning the modules when several are used to construct a single building.

BRIEF STATEMENT OF THE INVENTION

According to the subject invention, the above-mentioned problems are overcome by the provision of a method of erecting an A-frame type building through the use of a module which includes a pair of pivotally interconnected wall members and a floor member which is preferably pivotally connected to one of the wall members in a manner such that the entire module can be folded into a flat configuration with the wall members and the floor member all extending generally parallel. To erect an A-frame structure, the module is positioned generally horizontally with the second wall member lying beneath the first wall member. The ends of the second wall member are pivotally connected to a suitable base and thereafter the first wall member is lifted to move its free end portions away from the pivotally connected end portions of the second wall member. When the free end portions of the wall members are spaced apart a distance corresponding to the desired width of the structure, the floor member is connected between the wall members so that the module assumes a rigid A-frame configuration. Thereafter, the entire module is pivoted about the base to its upright position.

As can be appreciated, any number of the modules can be positioned in end-to-end relationship to produce buildings of substantial length. Additionally, various pivotally mounted partitions and floor panels can be built into the modules and swung out at various times during the erection procedure.

OBJECTS OF THE INVENTION

Accordingly, an object of the invention is the provision of an A-frame building module which is extremely versatile and can be rapidly and easily erected on site.

A further object is the provision of a building module of the general type described which can have a variety of different configurations including interior floor panels and partitions in which modules can be folded substantially flat into a compact configuration for shipping, handling and storage.

A still further object is the provision of a method of erecting a module easily and rapidly on site.

BRIEF DESCRIPTION OF THE DRAWINGS

The above and other objects and advantages wil become apparent from the following description when read in conjunction with the accompanying drawings wherein:

FIGS. 2–7 are diagrammatic line drawings illustrating the preferred sequence of steps for erecting the frame assembly of FIG. 1;

DETAILED DESCRIPTION OF THE DRAWINGS

Figure 1:
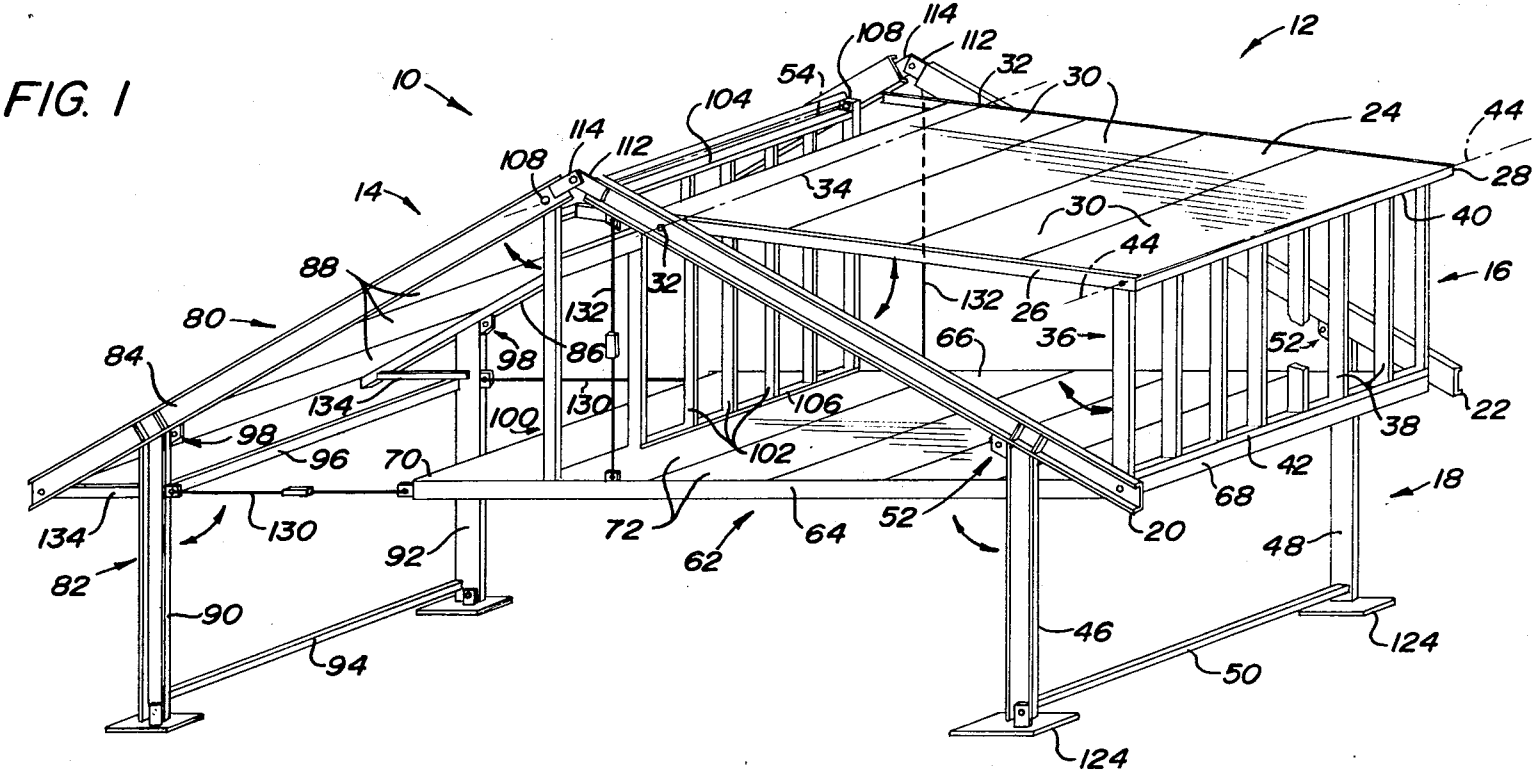
FIG. 1 is a pictorial showing, somewhat diagrammatic, of a building frame assembly embodying features of the subject invention.

Referring more particularly to the drawings wherein the showings are for the purpose of illustrating preferred embodiments of the invention only, and not for the purpose of limiting same, FIG. 1 shows a partially-finished building 10 which has been erected with a pair of building modules 12 and 14 formed in accordance with the preferred embodiment of the invention and erected by use of an inventive method which will subsequently be described in some detail. As will hereafter become apparent, the details of the modules 12 and 14 could vary substantially from the specific structures shown; however, module 12 is shown as comprising a roof frame assembly 16 and a side or wall frame assembly 18. The roof frame assembly 16, as well as the side frame assembly 18, could be formed from plate-like, panel or structural frame members or a combination thereof. The degree of completion of the various assemblies can be varied depending upon economic factors.

In the subject embodiment, the roof frame assembly 16 is shown as including a pair of channel-shaped side frame members 20 and 22. Connected between the side channels 20, 22 is a roof panel 24 defined by a pair of small side frame channels 26, 28 and interconnecting roof or decking panels 30. The roof panel member 24 is connected to the side channels 20, 22 by pivot connections 32 which are arranged to permit the roof 24 to pivot, as shown by the arrow, relative to the side channels 20, 22 about a generally horizontal axis 34.

Carried from the outer end of the roof panel 24 is a wall panel or frame member 36 which could have many constructions but is shown as comprising a plurality of studs 38 extending between spaced upper and lower frame members 40, 42, respectively. The wall panel or frame 36 is pivotally connected to the outer or right-hand end (as viewed in FIG. 1) of the roof panel assembly 24. As can be seen, suitable pivot connections are provided to allow the wall frame assembly 36 to swing or pivot about an axis 44 which is parallel to the previously mentioned axis 34. As can be appreciated, the panel or frame 36 can be pivoted in the direction shown by the arrow to assume a folded position between the roof frame members 20 and 22 parallel to the roof panel 24. Additionally, the entire roof frame 24 together with the side frame 36 can be pivoted about axis 34 to lie within the main roof channels 20, 22.

Figure 18:
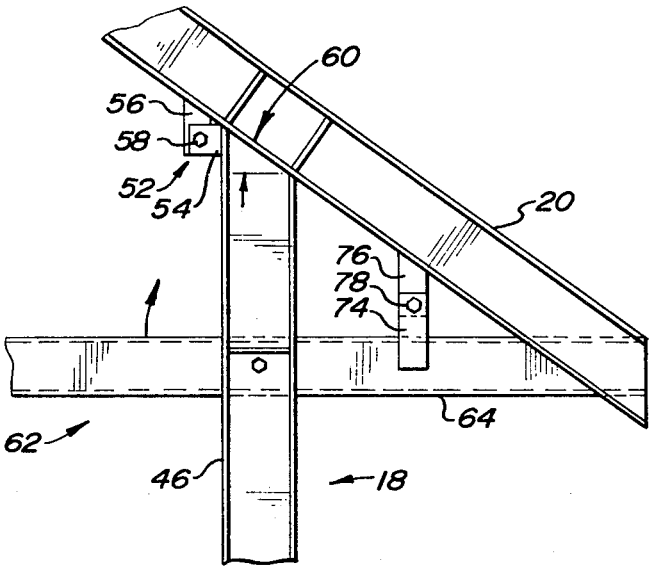
FIG. 18 is a detailed showing of the juncture between the roof frame and the side frame of the FIG. 1 embodiment after the building has been erected.

The side frame 18 of the subject embodiment comprises a pair of spaced, generally parallel, channel members 46 and 48 which are rigidly joined at their lower ends by a structural member 50. As will subsequently become apparent, the side frame assembly 18 could be of panel construction and/or include several more structural members if desired. The upper ends of the channel members 46 and 48 are pivotally connected adjacent the outer ends of the roof frame channels 20, 22 by suitable pivot or hinge connections 52. As best shown in FIG. 18, the hinge assembly 52 includes plates 54 and 56 which are welded to the channel members 46 and 20, respectively. A suitable bolt or pivot pin 58 extends between the two plates to pivotally interconnect the roof frame assembly and the side frame assembly. Additionally, for reasons which will subsequently become apparent, the upper end of the side frame channel members 46 and 48 are cut at an angle as identified by the reference numeral 60 in FIG. 18.

The module 12 of this embodiment further includes an interior floor panel or frame assembly 62. Floor panel assembly 62 is arranged so that it can be folded generally between the roof frame 24 and the side frame assembly 18 so that the entire module 12 can be folded into a flat, compact unit for shipping or storage, As will become apparent, a floor panel such as panel 62, if used in the module, could be connected to either the roof frame assembly 24 or the side frame assembly 18. Alternatively, it could be pivoted to the module at the juncture between the side frame and the roof frame.

Figure 19:
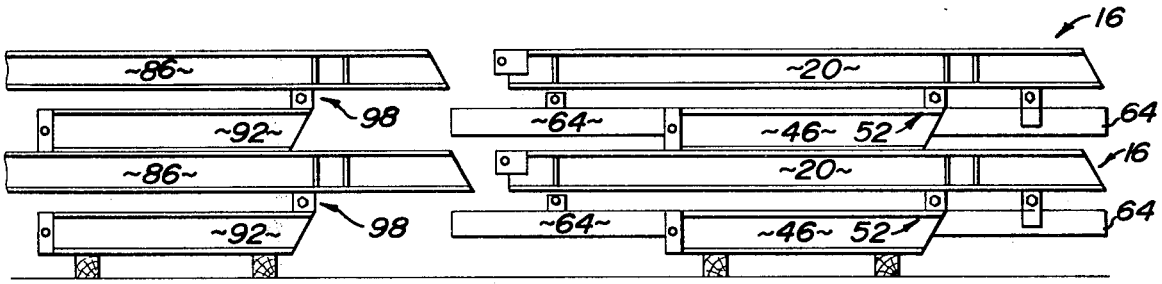
FIG. 19 shows a group of building modules of the type used in the FIG. 1 embodiment folded flat for shipping or storage.

In the subject embodiment, the floor frame assembly 62 comprises a pair of side channels 64, 66 connected at their opposite ends by suitable cross beams 68 and 70. Additionally, floor panels and suitable support members 72 extend between the side members 64, 66. The entire floor frame assembly 62 is pivotally connected adjacent its right-hand end (as viewed in FIG. 1) to the right-hand end of the roof frame assembly 16. The connections between the floor frame assembly 62 and the roof frame assembly 16 are best illustrated in FIG. 18. As shown, a plate member 74 is rigidly connected to the side channel 64 in the manner shown. A similar downwardly extending plate 76 is connected to the roof frame channel 20. A bolt or pivot pin 78 interconnects the two plates 74, 76 so as to permit pivotal movement between the floor frame 62 and the roof frame 16. A similar hinge assembly connects between the floor frame member 66 and the roof frame assembly channel member 22. In this way, the floor frame 62 can pivot relative to the roof frame assembly about an axis parallel to axes 34 and 44. Additionally, this arrangement permits the floor frame 62 to be folded into a position generally parallel to the roof frame 16 and the side frame 18. FIG. 19 illustrates a pair of modules 12 in their folded position such as they would be during shipping or storage.

As will subsequently be discussed in detail, both of the modules 12 and 14 could be of identical construction; however, in the subject embodiment, module 14 differs substantially from module 12. Specifically, module 14 comprises a roof panel or frame assembly 80 and a side frame assembly 82. The roof frame assembly 80 includes a pair of channel members 84 and 86 interconnected by roof panel members 88. The panels 88 can be of any desired type having the required structural strength. Preferably, they are positively interconnected between the side channels 84, 86. Although not shown, the final exterior roofing material can be applied directly to the panels 88.

The side frame 82 in this embodiment is shown as comprising a pair of generally vertically extending channel members 90, 92 that are interconnected by horizontally extending structural members 94, 96. The side frame assembly 82 is pivotally connected to the roof frame assembly 80 by hinge-type connections 98. This arrangement permits the side frame assemblies 82 to be pivoted or folded relative to the side channels 84, 86, as shown by the arrow, so as to lie generally parallel thereto. A module 14 in its collapsed or folded condition is illustrated in FIG. 19.

In the embodiment under consideration, the module 14 also includes an interior partition frame assembly 100. The partition frame 100 is shown as comprising a plurality of vertically extending studs 102 which can be metal, wood, or even panels if desired. The studs 102 extend between upper and lower members 104 and 106, respectively. The partition assembly 100 is pivotally connected to the roof frame assembly 80 by pivot pins or bolts 108. This permits the partition 100 to be rotated to a folded location generally within the same plane as the side channels 84, 86. Note that, as viewed in FIG. 1, the partition wall can be rotated clockwise, as shown by the arrow, to a location within or between the two side frames 84, 86.

Figure 20:
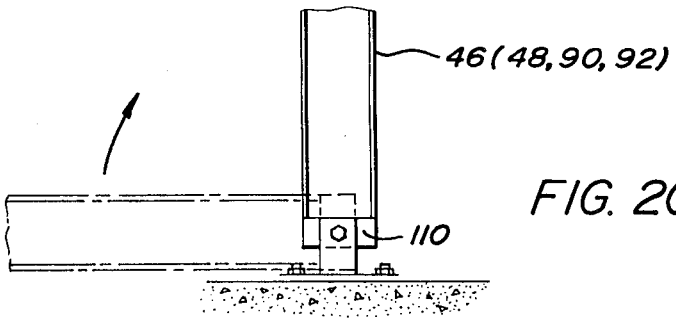
FIG. 20 shows the mounting between the lower end of the side frames and the base of the FIG. 1 embodiment.

Two relatively important aspects of the modules 12 and 14 which have not previously been discussed are the connecting means provided at the lower ends of the side frame assemblies and the upper or outer ends of the roof frame assemblies. It is these connecting means which allow the modules to be erected by the inventive method. In general, the connecting means at these locations are arranged to permit pivotal movement of the sides about an axis parallel to the previously mentioned axes 34, 44 and 54. Although many different types of connection means could be provided, in the subject embodiment, as best shown in FIG. 20, the lower ends of the side frame members 46, 48, 90 and 92 are provided with a reinforcing plate 110 having a pivot pin receiving an opening formed therethrough.

The connecting means at the ends of the roof frame assemblies 16 and 80 merely comprise plates 112 and 114 positively connected to the ends of the associated respective channel members 84, 86, 20, 22, and provided with bolt or pivot pin receiving openings which can be brought into alignment.

FIGS. 2–7 illustrate, in diagrammatic form, the preferred sequence of steps used for erecting the building of FIG. 1 from the modules 12 and 14.

As shown in FIG. 2, the modules 12 and 14 are positioned in spaced-apart relationship to lie generally horizontally. The module 12 has the free end of the side frame assembly 18 (the lower ends of members 46 and 48 as viewed in FIG. 1) pivotally connected to a rigid base member 120.

Figure 6:
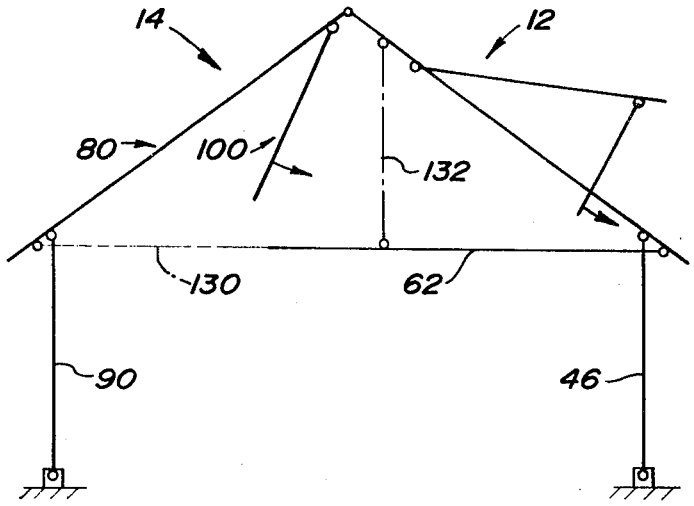

In the subject embodiment, the rigid base member 120 comprises spaced-apart plates 122 extending upwardly from a concrete foundation 124; however, any suitable type of base could be used. The openings in the lower ends of the members 46 and 48 are aligned with the openings in the upwardly extending plates 122, and suitable pivot pins or bolts placed therethrough. Similarly, the module 14 has the lower ends of its side frame pivotally connected to similar foundation or base members for rotation about an axis parallel to the previously mentioned axes 34 and 44. The distance D between the bases of each module represent the width of the building. With the modules 12 and 14 in the position indicated, the module 14 is lifted through the use of a crane or the like to bring the free end of its roof assembly 80 over into engagement with the free end of roof assembly 16 of module 12. The dotted line showing of FIG. 3 illustrates module 14 as it is being swung to the solid line position wherein the openings in plates 114 are aligned with the openings in plates 112. At this time, suitable bolts or pivot pins can be passed through the openings to pivotally interconnect the free ends of the two roof assemblies. Thereafter, as shown in FIG. 4, the two modules are lifted vertically causing the side frame assemblies 82 and 18 to pivot in a counterclockwise direction (as viewed in FIG. 4). During the lifting movement of FIG. 4, the floor panel member 62 of module 12 will swing counterclockwise from its original position in the roof assembly. Suitable cables or the like can be connected between the roof assembly 16 and the floor panel assembly 62 to limit the relative movement during this portion of the erection procedure. The lifting continues through the position illustrated in FIG. 5 until reaching a final position as shown in FIG. 6. FIG. 6 illustrates the final aligned position of the roof panel assemblies and the side panel assemblies. The assemblies must, generally, be brought into precise alignment through the use of adjustable tensioning means.

Figure 21:
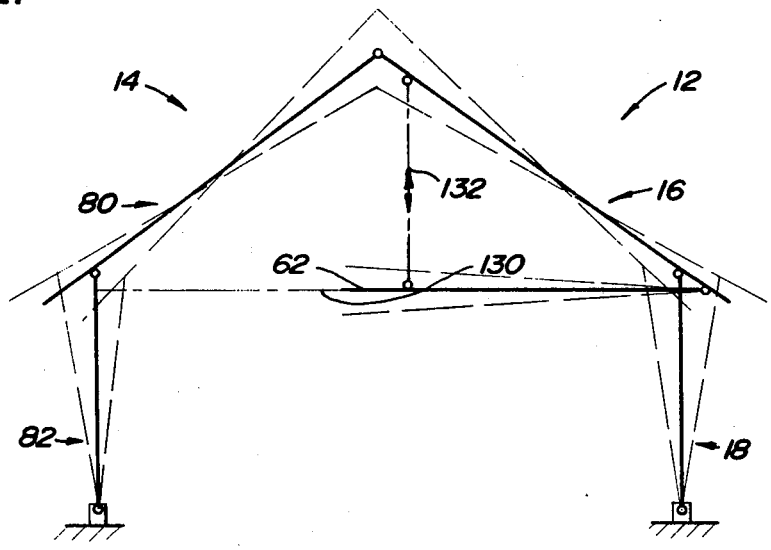
FIGS. 21 and 22 are diagrammatic line illustrations showing how adjustment of the FIG. 1 embodiment can be carried out.
Figure 22:
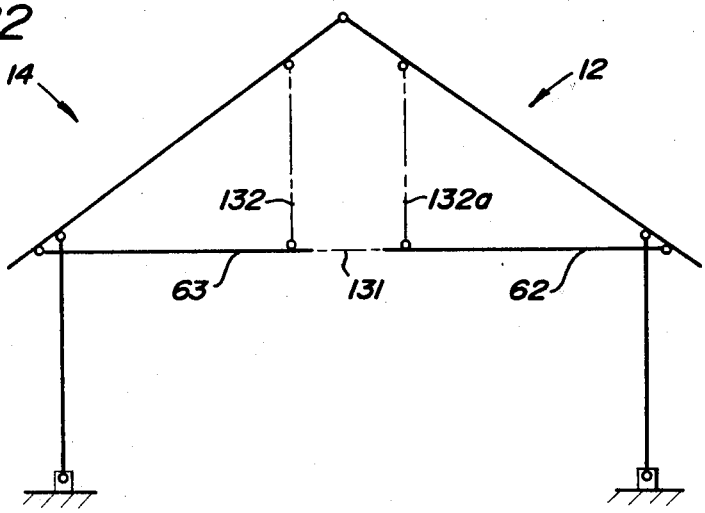

Referring again to FIG. 1, it will be noted that horizontal tensioning members 130 are connected between the free end of the floor assembly 62 and the vertical channel members 90, 92 of side assembly 82. Additionally, adjustable tension members 132 extend vertically between the floor assembly 62 and the channels 20, 22. The adjustable tensioning means 130 and 132 could be of many types such as, for example, cables and turnbuckles, adjustable straps, or the like. With the adjustable tensioning means 130 and 132 in position, final adjustment of the building alignment can take place. FIGS. 21 and 22 show how various adjustments can be made by tightening the adjustable tension members. As shown in FIG. 21, the horizontal tension member 130 can be adjusted to control or regulate the parallelism of the side walls. Note that by tightening the tension member 130, the side wall assemblies 18 and 82 can be pulled toward one another. Similarly, by loosening the tension member 130, they can be moved outwardly away from one another at their upper ends. Similarly, the tension member 132 can be adjusted to control the interior floor panel 62. By proper adjustment of the tension members, the building can be brought into exact final orientation. FIG. 22 shows a slightly modified form of tensioning or adjusting in which the building is shown as having two interior floor panels 62 and 63 carried by the modules 12 and 14, respectively. In this embodiment, the horizontal tension member 131 is connected between the ends of the floor panels to perform exactly the same functions as the previously discussed tension member 130 of FIG. 21. In this configuration, however, two vertical tension members 132 and **132*a* are provided for adjusting the position of the floor panels 62, 63, respectively. It should be appreciated that the two members can extend between different parts of the modules and perform generally the same functions. For example, the horizontal tension member could extend between the roof assemblies of the modules or between the roof assembly of one module and the side wall assembly of the other module. Alternatively, it would be possible for the vertical tension members to extend between the floor panel of one module and the roof assembly of the other module. Irrespective of the manner in which the members are connected, it should be understood that when the alignment is completed, knee braces or the like 134 are positively connected between the side frame members 90, 92 and the lower ends of channels 84, 86. Additionally, the side members 64, 66 of the floor assembly can be bolted or otherwise positively connected to the side frame members 46, 48.** Upon completion of these connections, the building is rigid and self-supporting.

Figure 7:
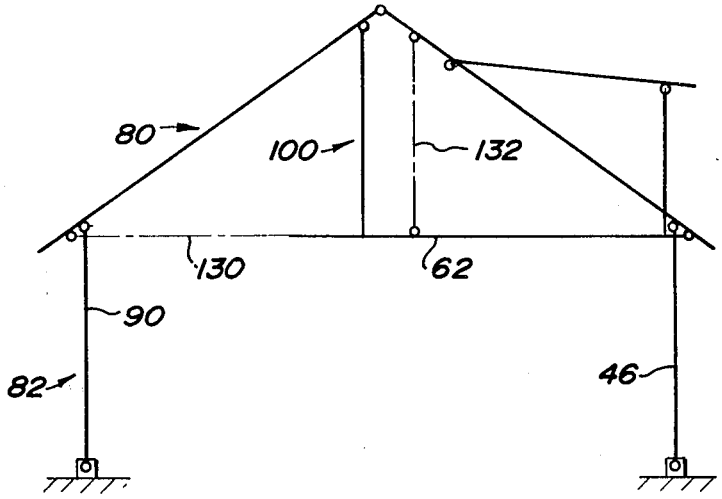
Figure 17:
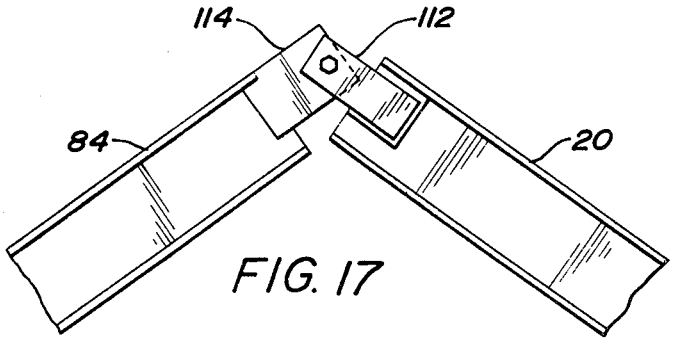
FIG. 17 is a detailed showing of the juncture between the roof panels of two interconnected modules of the FIG. 1 embodiment.

Either before or after the above sequence of operations, the roof panel assembly 24 of module 12 can be moved to its final position as well as the interior partition 100. FIGS. 6 and 7 illustrate the final erection of these two assemblies. As shown in FIG. 6, the roof panel assembly 24 is pivoted outwardly about axis 34 in a counterclockwise direction. Simultaneously therewith, the wall frame assembly 36 is pivoted in a counterclockwise direction about axis 44 to the final position shown in FIG. 7. After being moved into its final position, the lower edge of the wall 36 can be positively connected to the floor assembly 62. Similarly, the connections between the wall 36 and the roof panel 24 as well as the connections between the roof panel 24 and the channels 20, 22 can be made rigid if desired.

The interior partition panel member 100 is pivoted counterclockwise from its folded position adjacent the roof frame assembly of module 14 to extend vertically downward and in engagement with the floor panel 62. FIG. 7 shows the interior partition 100 in its final location.

Figure 8:
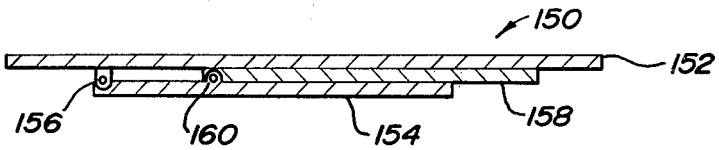
FIG. 8 is a view of a building module formed according to one embodiment of the invention (the module of FIG. 8 is shown folded in a flat condition for shipment or storage)
Figure 9:
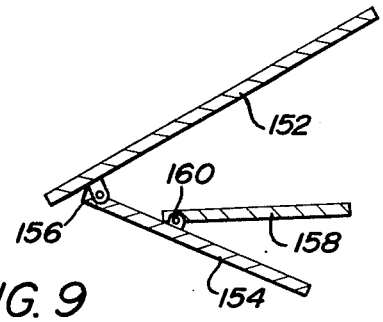
FIG. 9 is a view of the module of FIG. 8 showing the module partially unfolded.

FIGS. 8–16 illustrate modified forms of the invention in terms of the construction of the modules and method by which they can be erected. Specifically, FIGS. 8 and 9 illustrate in diagrammatic form a module 150 which comprises a roof frame or panel assembly 152 and a side frame or panel assembly 154 which are pivotally interconnected through pin connection 156. An interior floor or partition panel 158 is connected to the side panel 154 by a pivot connection 160. As shown in FIG. 9, the panels can be unfolded by pivoting them relative to one another from their flat storage or shipping arrangement of FIG. 8.

Figure 10:
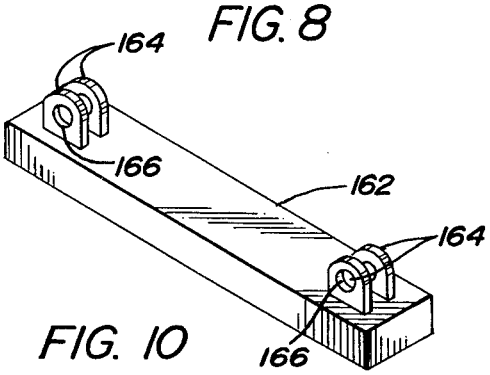
FIG. 10 is an isometric view of a base element which can be used for attaching the side elements of the modules during erection of a building.
Figure 11:
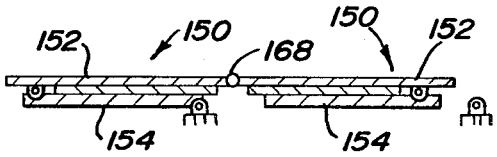
FIGS. 11–14 are diagrammatic showings of a sequence of steps which can be used for erecting buildings according to a second embodiment of the invention.
Figure 12:
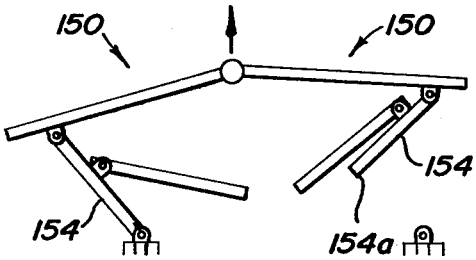
Figure 13:
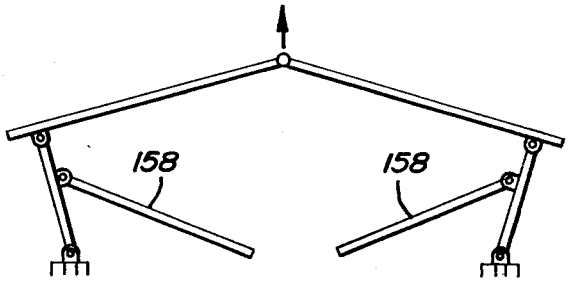
Figure 14:
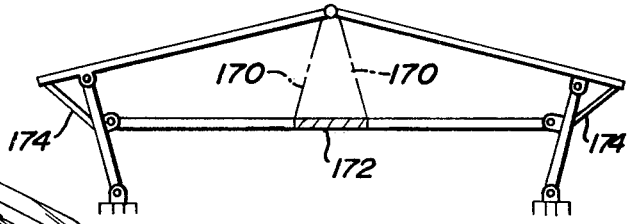

FIG. 11 illustrates how two of the modules 150 can be interconnected while in their folded condition for erection. In general, a suitable base prepared on the building site must be provided. FIG. 10 illustrates a suitable base member 162 which includes two pairs of upwardly extending plates 164 having a pivot opening 166. A suitable number of these members 162 could be placed in alignment and the lower end or free end portion of the wall panel 154 of one of the modules 150 pinned thereto. The other module 150 would then be positioned as shown in FIG. 11 and terminal or free end of its roof panel 154 connected to the terminal or free end of the other roof panel by a suitable pivot connection 168 such as, for example, of the type described with reference to the FIG. 1 embodiment. Thereafter, a crane or other lifting mechanism can be attached at 168 to lift the modules from the position shown in FIG. 11 to the position shown in FIG. 12. In this position, the side panel 154 of the right-hand module 150 can be pivoted downwardly and its lower end 154*a* attached to the right-hand base member with a suitable pivot connection. The modules will then have the general arrangement shown in FIG. 13. The crane or other lifting mechanism will hold the peak in the elevated position while the internal floor panels 158 are swung upwardly to a generally horizontal position. As shown in FIG. 14, tension members 170 can be connected between the peak and the ends of the floor members 158 and the ends of the floor members joined directly or by a strut member 172. By adjustment of the strut member 172 and the tension members 170, the building can be brought into alignment. Thereafter, knee braces or the like 174 can be welded or otherwise positively joined to the roof panels and the associated side panels to add structural strength to the building.

Figure 15:
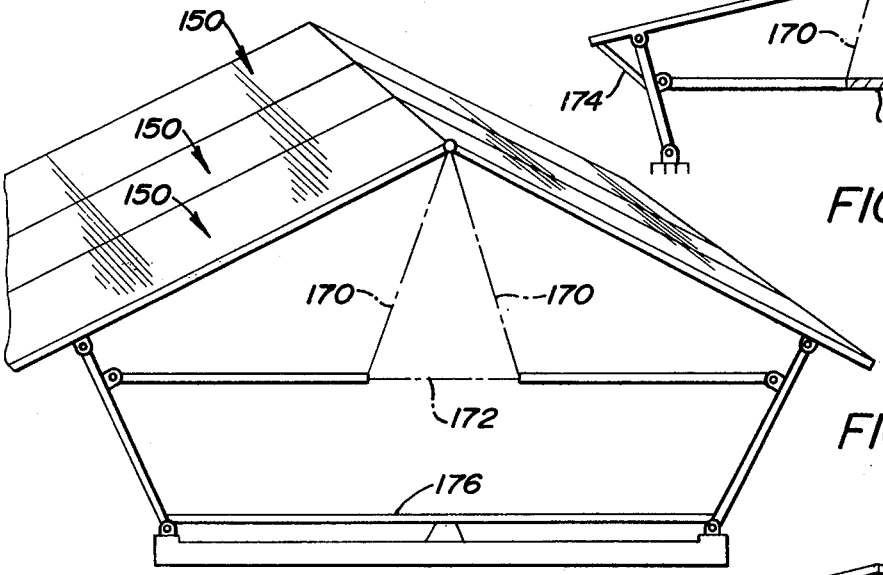
FIG. 15 is a pictorial view of the building erected according to the sequence of FIGS. 11–14 which illustrates the manner by which the building can be adjusted to its desired final alignment.
Figure 16:
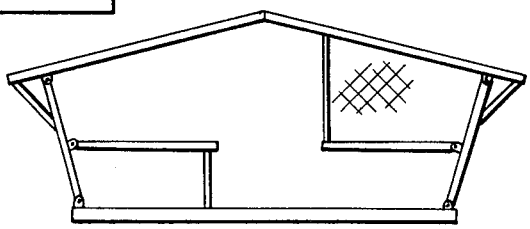
FIG. 16 is an end view showing a modified form of building which can be erected according to the subject invention.

FIG. 15 illustrates how a series of separate modules can be joined end-to-end to provide a building of substantial length. Note that in this embodiment, three of the modules 150 are positioned in side-by-side relationship down each half of the building. As shown, a floor member 176 can be installed between the side panels 154.

FIGS. 23–27 illustrate a module structure and method of erecting the same for constructing an A-frame type building. In this structure, the module 200 comprises a pair of wall-defining members 202 and 204. The wall-defining members can be merely structural frames to which suitable panels or the like can be attached after the module is erected. Alternatively, the members can be complete paneled structures prior to erection.

The members 202 and 204 are joined generally at their first end portions 206 and 208, respectively, by a pivot connection 210. In this embodiment, the connection 210 merely comprises suitable structural bolts 212. As can be seen, this allows the two wall members to have relative pivotal movement about a first axis 214.

The module 200 preferably further includes a floor panel or member 216. Floor member 216 is desirably connected to one or the other of the wall members 202 or 204. In the structure shown, floor member 216 is pivotally connected to wall member 204 for free movement about axis 218.

Figure 23:
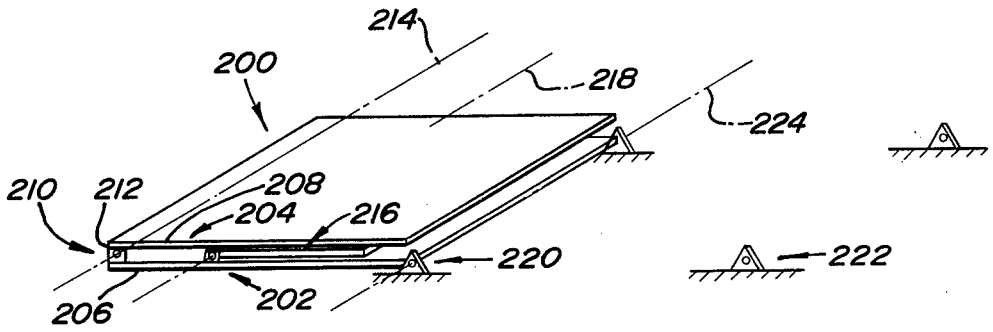
FIG. 23 is a somewhat diagrammatic pictorial view of a module particularly suited for forming an A-frame type structure; and, FIGS. 24–27 are diagrammatic views showing the sequence of steps used to erect the module of FIG. 23.

The module structure thus far described is such that it can be folded into the configuration shown in FIG. 23. Note that the wall members lie in generally parallel relationship with the floor member therebetween. It should be understood that although the floor member 216 is shown as connected to the wall member 204, it could equally well be connected to wall member 202. Also, as will subsequently become apparent, the floor member could comprise two or more members connected to either or both of the wall members. Alternatively, all connections of the floor member could be made during the erection procedure which will subsequently be explained.

Figure 24:
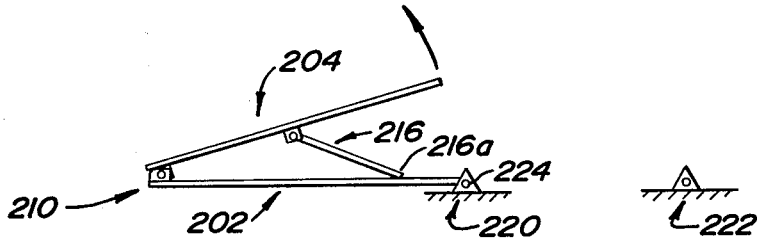

The described module can, as previously mentioned, be folded into a compact structure as illustrated in FIG. 23. The preferred method of erecting the module 200 is illustrated in FIGS. 24–27. As shown in FIG. 24, the erection procedure begins with the provision of a pair of spaced bases or foundation members 220 and 222. The bases 220 and 222 are spaced apart a distance substantially corresponding to the desired width of the resulting A-frame building. Thereafter, the module 200 is brought into position as shown in FIG. 23. The module is positioned generally horizontally with wall member 202 lying subjacent wall member 204. The free end portions of wall member 204 extend toward base 222.

With the module in position, the free end portions of wall member 202 are connected to base 220 for pivotal movement about an axis 224. Axis 224 is generally parallel to axis 214.

Figure 25:
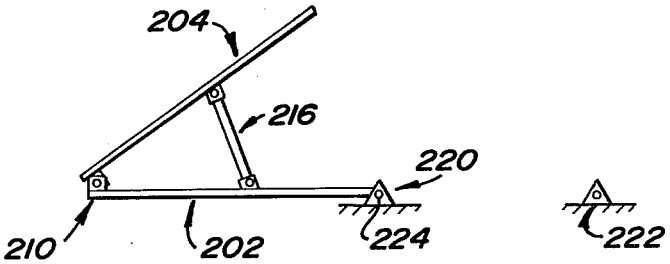

When wall member 202 is connected to base 220, the upper wall member 204 is lifted as shown in FIG. 24 to the position shown in FIG. 25. In this position the free end portions of the wall members 202 and 204 are spaced apart a distance substantially equal to the distance between bases 220 and 222.

During lifting of wall member 202, the floor member 216 pivots or swings to the position shown in FIG. 25. At this time, the free end 216*a* is joined to wall member 204. The module 200 then has a rigid A-frame configuration as seen in FIGS. 25 and 26.

Figure 26:
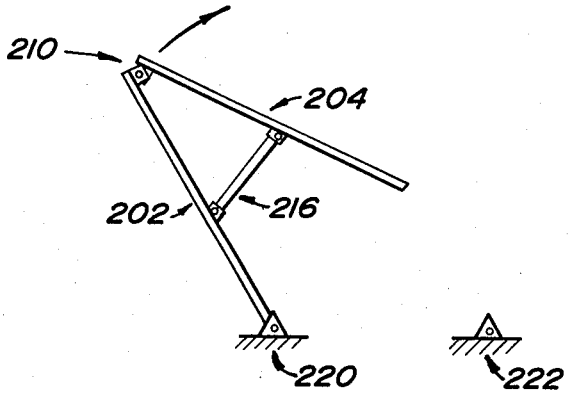
Figure 27:
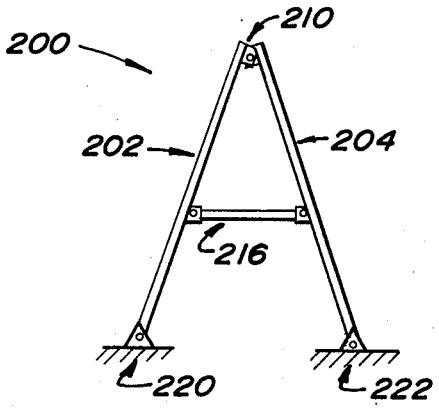

After the module has been rigidly connected, it is lifted or rotated to swing it about axis 224 as shown in FIG. 26 to bring the free end of wall member 204 into engagement with base 222. Thereafter, a connection with base 222 can be made if desired.

The invention has been described in great detail sufficient to enable one of ordinary skill in the art to make and use the same. Obviously, modifications and alterations of the preferred embodiment will occur to others upon a reading and understanding of the specification and it is our intention to include all such modifications and alterations as part of our invention insofar as they come within the scope of the appended claims.

What is claimed is:

1. A method of constructing an A-frame type structure comprising:

a. providing first and second spaced apart base members;

b. providing a module including first and second wall-defining members each having first and second end portions with the first end portion of the first wall member pivotally connected to the first end portion of the second wall member to permit said wall members to be folded about a first axis to lie in side-by-side generally parallel relationship;

c. positioning said module in its folded condition to lie in a generally horizontal position with the second wall member subjacent the first wall member and connecting the second end portion of the second wall member to the first base for pivotal movement about a second axis parallel to said first axis with second end portion of the first wall member extending generally toward said second base;

d. lifting said first wall member to pivot it about said first axis and moving the second end portions of said wall members a distance apart substantially equal to the distance between said base members;

e. providing a floor member and with said first wall member in the lifted position interconnecting said first and second members with said floor member extending therebetween; and, f. thereafter lifting said module to rotate it about said second axis to move the second end of said first wall member into engagement with said second base.

2. The method as defined in claim 1 wherein said floor member is pivotally connected to one of said side members prior to lifting said module.

3. The method as defined in claim 1 wherein said floor member is pivotally connected to one of said side wall members to lie between said wall members when said module is in said folded condition.

4. The method as defined in claim 1 wherein said floor member is connected generally midway between the ends of said wall members.

5. A method of erecting an A-frame structure comprising the steps of:

a. providing first and second wall members each having first and second end portions;

b. providing first and second spaced bases;

c. interconnecting the first end portion of each of said wall members for pivotal movement about a first axis to provide a module which can be folded into a configuration wherein said wall members are in side-by-side generally parallel relationship;

d. positioning said module in its folded configuration with the second wall member subjacent the first wall member and the second end portion of the second wall member extending toward the first base;

e. pivotally connecting the second end portion of the second wall member to said first base for pivotal movement about a second axis generally parallel to said first axis;

f. lifting said first wall member to move the second end portion thereof away from the second end portion of the second wall member a distance substantial equal to the spacing between said first and second bases;

g. interconnecting said first and second wall members to maintain the spacing between the second end portions of said wall members; and, thereafter, h. lifting said module to rotate it about said second axis and move the second end of the first wall member into engagement with said second base.

6. The method as defined in claim 5 wherein said second wall member is maintained generally stationary during lifting of said first wall member.

7. The method as defined in claim 5 including the step of connecting the second end portion of the first wall member to the second base.

* * * * *